United States Patent [19]

Grüttner et al.

[11] 4,419,151

[45] Dec. 6, 1983

[54] CRYSTAL AND GERMANIUM MODIFICATION AND PROCESS FOR ITS PREPARATION

[75] Inventors: Andreas Grüttner; Reinhard Nesper, both of Stuttgart; Hans-Georg von Schnering, Aidlingen, all of Fed. Rep. of Germany

[73] Assignee: Max-Planck-Gesellschaft zur Förderung der Wissenschaften e.V., Gottingen, Fed. Rep. of Germany

[21] Appl. No.: 354,476

[22] Filed: Mar. 3, 1982

[30] Foreign Application Priority Data

Mar. 11, 1981 [DE] Fed. Rep. of Germany ..... 3109229

[51] Int. Cl.[3] ..... C22B 41/00

[52] U.S. Cl. ..... 148/400; 156/624; 420/556; 420/903; 429/218

[58] Field of Search ..... 420/556, 903; 148/400, 148/404, 405, 31.55; 156/624; 429/418

[56] References Cited

U.S. PATENT DOCUMENTS 2,766,152 10/1956 Wainer et al. ..... 156/624
2,858,730 11/1958 Hanson ..... 88/14
3,650,702 3/1972 Swets ..... 156/624

OTHER PUBLICATIONS

Shunk, "Constitution of Binary Alloys, Second Supplement" ©1969, p. 387.
Elliot, "Constitution of Binary Alloys, First Supplement" ©1965, pp. 479–480.
Billig E., "Growth of Monocrystals of Germanium from an Undercooled Melt" Proc. Roy Soc. A, vol. 229, pp. 346 to 363 1955.
Hamilton, D. R. et al., "Propagation Mechanism of Germanium Dendrites" J. App. Phy., vol. 31, No. 7, Jul. 1960, pp. 1165–1168.
Wichner R. et al., "Ge Crystal Growth and Evaluation as Ge(Li) Detector Material" IEEE Nuc. Sci., vol. 17, No. 3, Jul. 1970, pp. 160–164.

*Primary Examiner*—L. Dewayne Rutledge
*Assistant Examiner*—Christopher W. Brody
*Attorney, Agent, or Firm*—Felfe & Lynch

[57] ABSTRACT

A new crystalline modification of germanium is described, as well as a method of manufacturing it. This new crystalline germanium modification has an orthorhombic structure and graphite-like properties.

16 Claims, No Drawings

CRYSTAL AND GERMANIUM MODIFICATION AND PROCESS FOR ITS PREPARATION

The subject of the invention is a new crystalline modification of germanium, as well as methods for its production.

Germanium has long been known as a very brittle element, having a diamond-type crystallization (a=0.56575 nm at 20° C.).

The subject matter of the invention is a new crystalline modification of germanium, which will be referred to hereinafter as "allogermanium", and which is characterized by the fact that it is in the form of plates of metallic luster having an orthorhombic structure and graphite-like properties. The germanium modification in accordance with the invention is similar to graphite in its properties, and it has a laminar structure which permits the individual plates to slide easily on one another.

Subject matter of the invention, therefore, is the crystalline modification of germanium or allogermanium in accordance with the principal claim. The subordinate claims relate to especially preferred embodiments of this subject matter, methods for producing this new crystal modification of germanium, the lithium-germanium compound of an orthorhombic structure having the formula $Li_6Ge_{12}$, which is used as an intermediate for the production of this crystal modification.

The crystalline germanium modification of the invention is characterized by the fact that it has graphite-like properties and a laminar structure of the orthorhombic type having the following characteristic unit cell parameters: a=0.777 nm and b=1,630 nm, while the lattice parameter c cannot be precisely determined, since considerable variations can occur on account of imperfections. The majority of the monocrystals obtained have a lattice parameter c of 2.388 nm.

The crystalline modification of germanium in accordance with the invention is obtainable by melting lithium and germanium together, cooling the melt with the formation of a lithium-germanium compound which apparently corresponds to the formula $Li_7Ge_{12}$, and hydrolysis of this lithium-germanium compound under the influence of protic solvents and/or reaction with a mild oxidizing agent.

The invention therefore also relates to a method of producing the crystalline modification of germanium, which is characterized by the fact that lithium and germanium are melted together, the melt is cooled, a crystalline lithium-germanium compound of orthorhombic structure is isolated which corresponds to the formula $Li_7Ge_{12}$, and this lithium-germanium compound is hydrolyzed under the influence of protic solvents and/or with a mold oxidizing agent, preferably with benzophenone. This reaction is best performed in an aprotic solvent, preferably tetrahydrofuran. The stoichiometric ratios are to correspond to the formula $0.01:1<Li:Ge<1:1$. When melting the starting materials together, it is preferred to use a lithium-germanium atom ratio to about 0.5 to 1.2:2. The compound, however, is obtained in the entire range of the above formula, with the highest yields in the approximately stoichiometric range. It is furthermore possible to pull monocrystals of the above-named lithium-germanium compound from the germanium-rich molten phase that has been formed by the melting together of the starting materials.

For the hydrolysis of the lithium-germanium compound, it is preferred to use water and/or an alcohol as the protic solvent, and more greatly preferred to use a low-molecular aliphatic alcohol, such as methanol, ethanol, propanol, isopropyl alcohol or butanol (including its various isomers).

If $Li_7Ge_{12}$ is hydrolyzed, the product has especially graphite-like properties, while the reaction with a mild oxidizing agent makes the three-dimensional structure more strongly apparent. The hydrolysis and oxidizing treatment can be combined.

The crystalline modification of germanium in accordance with the invention is a semiconductor with approximately twice the band gap of the conductor properties of normal germanium having diamond-type crystallization (α-germanium).

On the basis of its properties, the germanium modification of the invention can be used as a semiconductor. It is particularly advantageous in an application such as this for the modification to be in the form of thin layers making it possible to produce the thin layers required for semiconductors mechanically or chemically without complex processes. At the same time, the layer thickness can be controlled by the nature of the production process.

The crystalline germanium modification of the invention, as a result of its laminar character and its surface active properties, can be used as a lubricant. This is due to the great surface area of the germanium modification of the invention, which can be made to react, for example, with other chemical substances while maintaining its laminar structure. Furthermore it is possible, as in the case of graphite, to form synthetic conductors by appropriately influencing the laminar structure by intercalation.

The preparation of the germanium moification of the invention is accomplished through a lithium-germanium intermediate compound formed by melting lithium and germanium together; of this intermediate, $$^{2}_{\infty}[Ge]^{7-}$$

is established as the anion and 7 $Li^+$ is assumed as the cation for each formula unit. It is to be presumed that the lithium cations are situated between the layers of the polyanion. The polyanions have a bidimensionally infinite, block-like structure. In the preparation of the crystalline germanium modification of the invention, it is necessary to avoid, insofar as possible, the formation of a lithium-germanium phase which is not bidimensional but in the form of a spiral and, as an impurity, acts against the graphite-like laminar structure and impairs the ability of the layers to slide against one another. Accordingly, it is preferable in accordance with the invention to use an excess of germanium, preferably a lithium-to-germanium atomic ratio of approximately 0.5 to 1.2:2, although a greater germanium excess can also be used, since the desired monocrystal of the lithium-germanium compound can be pulled from the germanium-rich molten phase.

It is under the influence of protic solvents that the crystalline lithium-germanium compound of orthorhombic structure obtained as intermediate is transformed to the crystalline germanium modification in accordance with the invention. In the hydrolysis with water or alcohols, the formation occurs of 7 LiOH and $7\frac{1}{2}$ $H_2$ or of the corresponding organic lithium compounds LiR, respectively, resulting in the formula $Li_7Ge_{12}$ given above. This composition has also been confirmed by means of the atomic absorption spectrum.

Through the selection of the protic solvent to be used for the hydrolysis, the oxidizing agent used for the reaction and the aprotic solvent if any, as well as the rate at which they are added, it is possible to a certain extent also to control the properties of the germanium modification in accordance with the invention. For example, with butanol as solvent, only a very slow hydrolytic cleavage of $Li_7Ge_{12}$ is accomplished, but especially thin layers are obtained in the form of very thin spangles. If water is used, the hydrolytic cleavage is performed rapidly, but the plates formed are substantially thicker. By the appropriate combination of protic solvent and the rate of its addition, it is thus possible to control especially the thickness of the layers obtained, so as to adapt the product to the desired application.

Also subject matter of the invention is the $Li_7Ge_{12}$ phase occurring as an intermediate, which is a very good ionic conductor and can be used as electrode material in lithium batteries.

The results of physical testing of the crystalline modification of germanium in accordance with the invention are set forth hereinbelow.

1. CONDUCTIVITY MEASUREMENTS

The conductivity of the crystalline germanium modification of the invention was measured both on powder samples and on monocrystals. In the case of the powder samples (compacts), a specific resistance was measured at room temperature of $10^5$–$10^6\Omega\cdot$cm, which decreases as the sample is heated.

In microwave conductivity measuremenets on monocrystals, repeatable values with regard to the resistance decrease in the temperature range from 290 to 370 K were obtained. Thereafter the resistance decreases as temperature increases. Between 370 K and 410 K the temperature-resistance relationship is approximately exponential, corresponding to an activation energy of about 1.1 eV. In these measurements, the phase transformation from the germanium modification to the ordinary form of $\alpha$-germanium at 450 K is manifested by an abrupt decrease of the electrical resistance.

2. RAMAN SPECTRA

The unpolarized Raman spectrum of the germanium modification of the invention was recorded with laser light of a wavelength $\lambda_L=514.5$ nm, and a power of p=100 mW. The spectrometer was a triple lattice monochromator (made by Spex). The slit width was 350 $\mu$m, which corresponds to a resolution of 6 $cm^{-1}$. The spectra were recorded at a scan speed of 6 $cm^1$, using a multiple channel analyzer with a time integration of 9 seconds per channel. The spectrum is characterized essentially by four broad intensity maxima at 94, 111, 186 and 289.5 $cm^{-1}$, which themselves consist of several intensity peaks.

Structures are thus observed such as are expected of the single phonon density of states of crystalline $\alpha$-germanium (diamond type) (cf. G. Nelin and G. Bilson, Phys. Rev. B5 (1972) 3151). In the area of the TA branches, two structures are clearly resolved at 94 and 111 $cm^{-1}$. From the frequencies, which are approximately the same as those measured in amorphous germanium, it can roughly be concluded that the covalent type of bonding is substantially preserved in the germanium modification of the invention.

Since the crystals are greatly distorted along the plate axis, greater peak half-value widths are observed than in a pure $\alpha$-germanium.

3. PHOTOELECTRON SPECTROSCOPY

The spectra from the photoelectron tests performed on the germanium modification of the invention were recorded with monochromated AlK$\alpha$ X-rays (using a Hewlett-Packard HP 5950 A ESCA spectrometer). The resolution was 0.6 eV at a vacuum of $2.67\cdot10^{-10}$ mbar.

From the recorded spectra it can be concluded that the plasmon energy of the germanium modification of the invention, of 17.3 eV, corresponds approximately to that of $\alpha$-germanium. This signifies that the germanium modification of the invention has an electron density similar to that of common $\alpha$-germanium.

It is remarkable that the valence band density of states differs from that of common $\alpha$-germanium with a diamond structure. On the basis of knowledge from Raman measurements and from crystal structural analysis it can be assumed that all of the germanium atoms of the modification in accordance with the invention have a four-fold covalent saturation. Evidently the differences in the configuration of the more remote neighboring atoms are responsible for the differences in the valence band density of states.

4. MAGNETIC MEASUREMENTS

The static magnetic susceptibility of the germanium modification of the invention was measured by means of a conventional apparatus (VTS-50 Squid Susceptometer made by SHE Corporation). The measurements were performed in a temperature range from 5° to 400° K. at 10 and 20 k Gauss. The individual samples were measured both below and above the phase transformation point. From the measurements obtained it can be concluded that the diamagnetism of the germanium modification of the invention, of approximately $-0.2\cdot10^{-6}$ $cm^3/g$, is greater by a factor of 2 than the value of $-0.091\cdot10^{-6}$ $cm^3/g$ measured on $\alpha$-germanium at temperatures above the transformation (literature value: $-0.106\cdot10^{-6}$ $cm^3/g$). The measurement made on the various samples prepared did not yield precisely repeatable values, but they were all in the same order of magnitude. After heating above the phase transformation point, the diamagnetic susceptibility was found to return every time to the value for $\alpha$-germanium.

On the basis of its laminar structure, the allogermanium of the invention can be transformed very easily to the thin flake form desired for semiconductors and therefore offers considerable technological advantages in the manufacture of semiconductors.

We claim:

1. Crystalline modification of germanium, characterized by plates of metallic luster with an orthorhombic structure.

2. Germanium modification of claim 1, characterized by a laminar structure with the characteristic parameters of the unit cell: a=0.777 nm and b=1,630 nm.

3. Germanium modification of claim 1 or 2, characterized by a specific resistance, measured on a powder sample, of $10^5$–$10^6\Omega\cdot$cm.

4. Germanium modification of claim 1, characterized by four broad, complex intensity peaks in the unpolarized Raman spectrum with laser light of a wavelength $\lambda_L=514.5$ nm, which are situated at 94, 111, 186 and 289.5 $cm^{-1}$.

5. Germanium modification of claim 1, characterized by a static diamagnetic susceptibility of $-0.2 \cdot 10^{-6}$ $cm^3/g$.

6. Germanium modification of claim 1, resulting from fusing lithium and germanium together using an excess of germanium, cooling the melt with the formation of a lithium-germanium compound of orthohombic structure of the formula $Li_7Ge_{12}$, and hydrolysis of this lithium-germanium compound under the action of protic solvents and/or reaction with mild oxidizing agents.

7. Method of manufacturing the germanium modification of claim 1 comprising melting together lithium and germanium in the ratio of 0.01:1 Li:Ge 1:1, cooling the melt, isolating a crystalline lithium-germanium compound of orthorhombic structure from the melt, and hydrolyzing the lithium-germanium compound with protic solvents and/or mild oxidizing agents.

8. Method of claim 7 wherein a lithium:germanium atomic ratio of approximately 0.5 to 1.2:2 is used.

9. Method of claim 7 further comprising the step of pulling the lithium-germanium compound of orthorhombic structure as a monocrystal from the germanium-rich molten phase.

10. Method of claim 7 wherein water and/or an alcohol is used as the protic solvent.

11. Method of claim 10 wherein a low-molecular aliphatic alcohol is used as the alcohol.

12. Method of claim 11 wherein the alcohol is methanol, ethanol, propanol, isopropyl alcohol or butanol.

13. Method of claim 7 wherein the mild oxidizing agent is used in a aprotic solvent.

14. Method of claim 13 wherein tetra-hydrofuran is used as the aprotic solvent.

15. Method of claim 7 or 13 wherein benzophenone is used as the mild oxidizing agent.

16. Lithium-germanium compound of orthorhombic structure of the formula $Li_7Ge_{12}$.

* * * * *